US010202771B2

(12) United States Patent
Edgson

(10) Patent No.: US 10,202,771 B2
(45) Date of Patent: Feb. 12, 2019

(54) ROOF GROWTH INHIBITING METAL STRIP

(71) Applicant: Mark Edgson, Prince George (CA)

(72) Inventor: Mark Edgson, Prince George (CA)

( * ) Notice: Subject to any disclaimer, the term of this patent is extended or adjusted under 35 U.S.C. 154(b) by 0 days.

(21) Appl. No.: 15/069,019

(22) Filed: Mar. 14, 2016

(65) Prior Publication Data

US 2017/0101783 A1 Apr. 13, 2017

Related U.S. Application Data

(63) Continuation-in-part of application No. 29/541,709, filed on Oct. 7, 2015.

(60) Provisional application No. 62/188,847, filed on Jul. 6, 2015.

(51) Int. Cl.
*E04D 13/00* (2006.01)
*E04D 1/30* (2006.01)

(52) U.S. Cl.
CPC ..... *E04D 13/002* (2013.01); *E04D 1/30* (2013.01); *E04D 2001/308* (2013.01)

(58) Field of Classification Search
CPC .... E04D 13/002; E04D 1/30; E04D 2001/308
USPC ..... 52/12, 14, 173.1, 515, 741.3, 518, 57, 52/101, 199
See application file for complete search history.

(56) References Cited

U.S. PATENT DOCUMENTS 1,475,931 A * 12/1923 Campbell ..... E04D 13/10 52/24
2,069,444 A * 2/1937 Honigbaum ..... E04D 1/26 52/524
3,296,750 A * 1/1967 Zaleski ..... E04D 13/10 52/24
3,411,259 A * 11/1968 Anderson ..... E04D 1/265 52/14
4,965,969 A * 10/1990 Antenen ..... E04D 13/076 248/48.1
5,216,864 A * 6/1993 Urgero ..... A01N 25/34 52/515
5,542,226 A * 8/1996 Markovich ..... E04D 1/26 33/562
5,664,374 A * 9/1997 Lee ..... E04D 13/10 52/24
7,788,870 B1 * 9/2010 Spencer ..... E04D 13/002 52/101
8,703,166 B1 * 4/2014 Flynn ..... A01N 25/12 106/1.26
9,103,124 B2 * 8/2015 Spencer ..... E04D 13/002
2003/0150170 A1 * 8/2003 Weber ..... E04D 1/06 52/1
2006/0070304 A1 * 4/2006 Barnett ..... E04D 13/076 52/11
2007/0039252 A1 * 2/2007 Railkar ..... E04D 13/002 52/44
2012/0192510 A1 * 8/2012 Spencer ..... E04D 13/00 52/173.1
2012/0324807 A1 * 12/2012 Spencer ..... E04D 13/002 52/173.1

* cited by examiner

*Primary Examiner* — Joshua K Ihezie
(74) *Attorney, Agent, or Firm* — John R. Benefiel

(57) ABSTRACT

Antigrowth roofing strips made of a metal which release antigrowth ions into rainwater runoff from the roof which are formed with nailing hole sets insuring covering of nail heads with shingles. The strips also are formed with variously bent up or down tabs enabling securement to roofing tiles.

2 Claims, 7 Drawing Sheets

ROOF GROWTH INHIBITING METAL STRIP

CROSS REFERENCE TO RELATED APPLICATION

This application a continuation in part of design application Ser. No. 29/541,709 filed on Oct. 7, 2015.

BACKGROUND OF THE INVENTION

This application relates to metal strips used to inhibit growths on roofs such as moss, algae, lichens, mold, mildew, etc. which have a tendency to occur on roofs. These growths are unsightly and also have a tendency to reduce the life of a roof.

This because water is retained by such growths delaying complete dry out of the roof after a rain, the resulting prolonged contact with moisture contributing to wear out of the roof covering.

It has long been known that strips of metals such as copper or zinc installed on the roof will deter such growths.

A metal strip (preferably of copper) shown and claimed in U.S. Pat. No. 9,103,124 is designed primarily for use on asphalt shingled roofs.

The roof growth problems are also encountered to an extent on tile roofs but heretofore such metal strips have not been adapted for use on tile roofs, since not being able to be attached securely.

Another problem is encountered with asphalt shingles in which the heads of nails used to secure the strips on asphalt shingled roofs are sometimes exposed when predrilled holes are provided for such nails. This is because such predrilled holes will line up with slots occurring along said shingles.

That is, since the strips have predrilled holes for receiving nails, exposure of the nail heads sometimes will occur since the holes randomly align with one of those slots formed along the length of a shingle.

It is an object of the present invention to provide such a metal strip which is configured for universal use, i.e., for asphalt shingle roofs or with tile or slate roofs.

It is another object to provide such a metal strip with predrilled nails holes for installation on a shingled roof in which the possibility of an exposed nail head is avoided.

SUMMARY OF THE INVENTION

The above recited objects and other objects which will be understood by one skilled in the art are achieved by providing a series of tabs along the upper side of the strip, each tab formed by pairs of spaced apart slots.

The tabs are bent up or down when the strip is being used on a tile roof as by use of so called "duckbill" pliers, the tabs having a crease to be easily folded straight along the width.

The tabs can be bent partially or completely up or down or at any angle (such as at a 45° angle) or bent over past 90° in either direction to be oriented to be engaged when a tile is installed so as to effectively engage the undersurface of a ridge tile to retain the strip beneath the ridge tile.

That is, the bent up tabs are sure to engage the undersurface of tiles installed along the ridge line and thereby be retained beneath the tiles.

In addition, sets of three predrilled nail holes are provided to eliminate the possibility of a nail head from being exposed by lining up with a shingle slot when installed using a predrilled nail hole.

DETAILED DESCRIPTION

Figure 1:
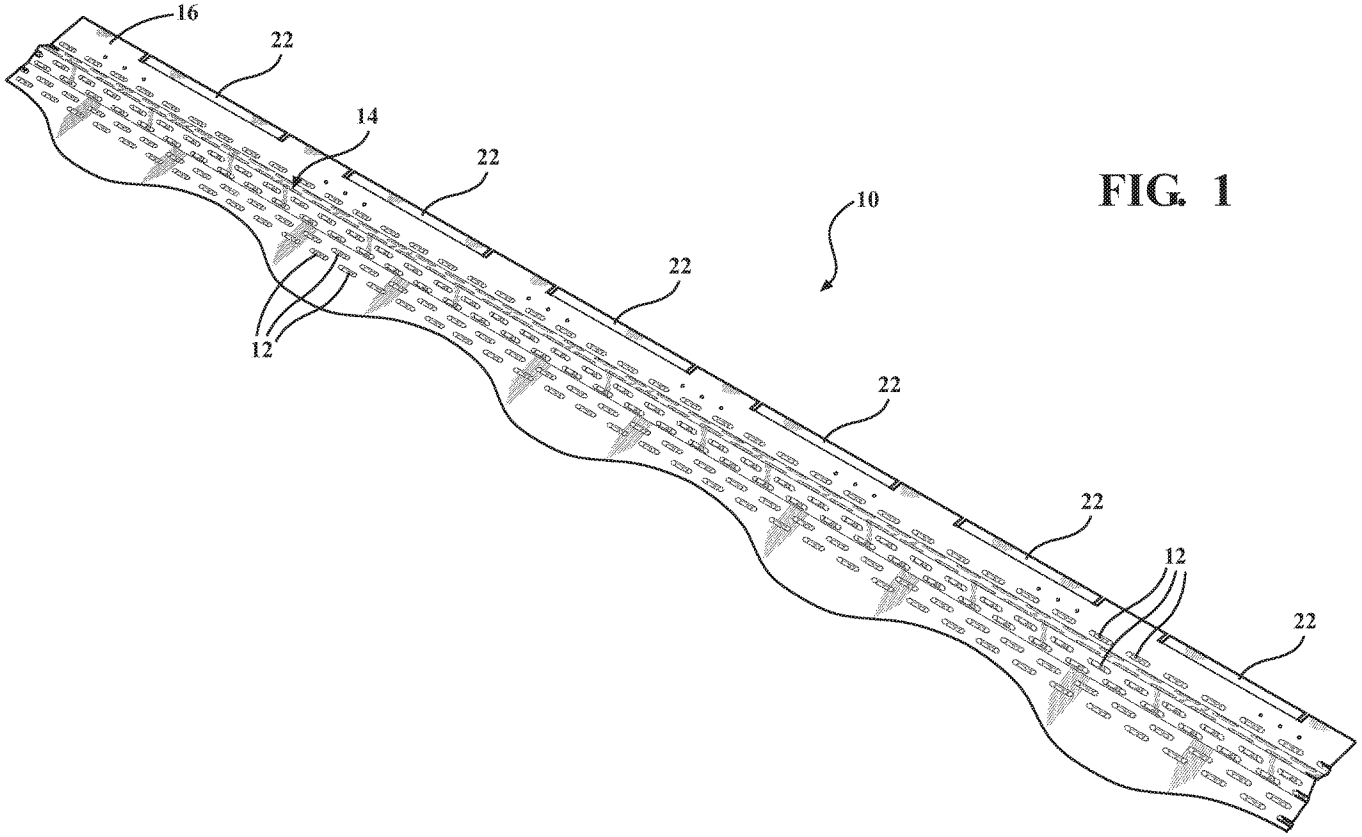
FIG. 1 is a pictorial view of a growth inhibiting metal strip installed on pitched roofs.
Figure 2:
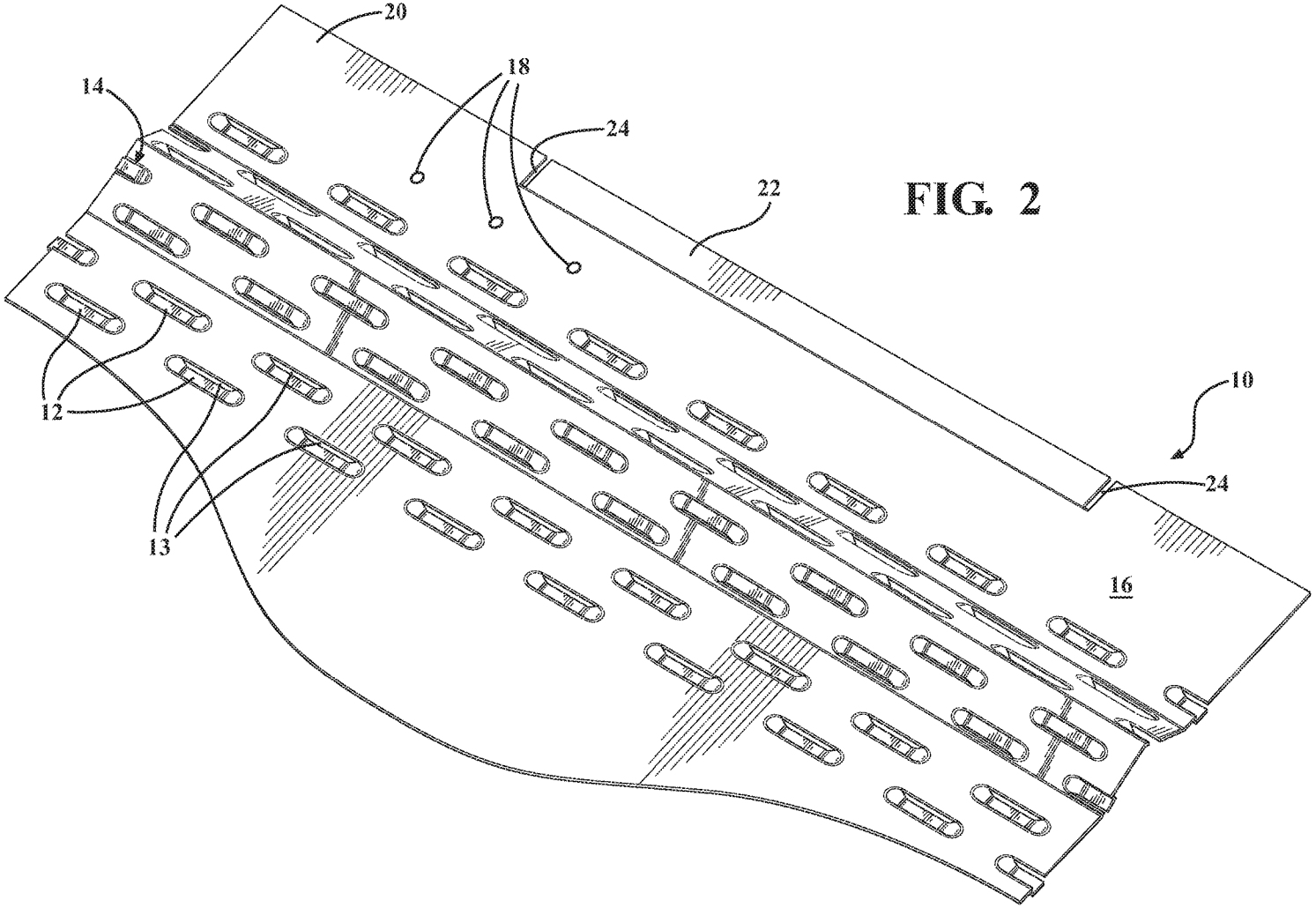
FIG. 2 is an enlarged fragmentary pictorial view of a segment of the strip shown in FIG. 1.
Figure 3:
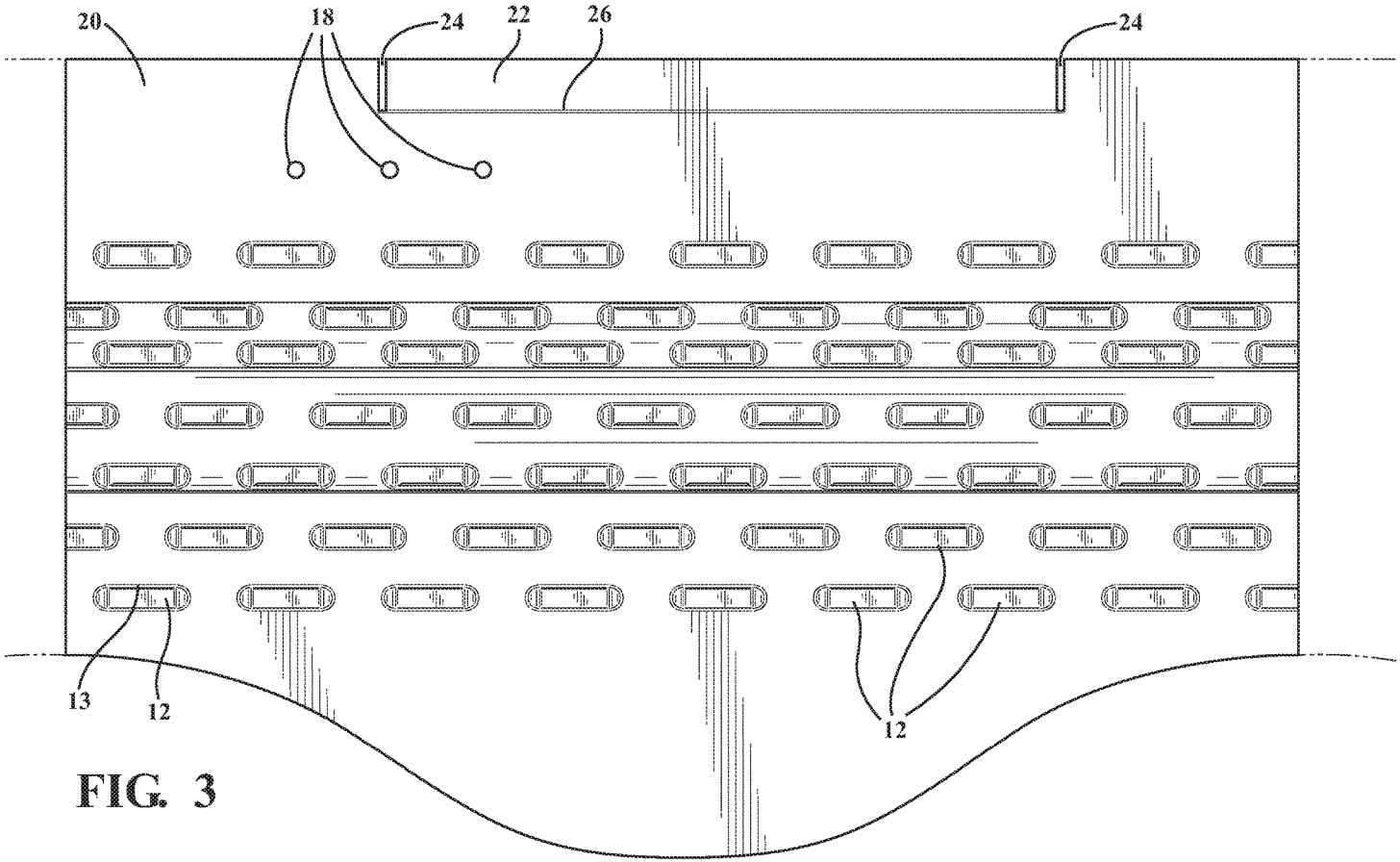
FIG. 3 is a plan view of the segment of the strip shown in FIGS. 1 and 2.
Figure 4:
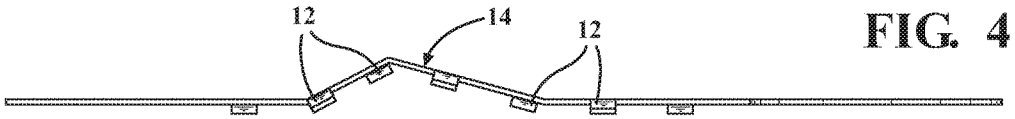
FIG. 4 is an end view of the strip shown in FIGS. 1 through 3.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 1-4, the present invention comprises elongated roofing strips of sheet metal 10, preferably constructed of copper, but alternatively able to constructed of other active metals such as zinc. As described in U.S. Pat. No. 9,103,124 incorporated herein by reference, such strips inhibit growths on roofs due to the release of ions into the rainwater running down the roof, the presence of such ions in the rainwater runoff inhibiting the development of growths such as moss, mildew, algae, mold lichens, etc.

The strip 10 may be about 36 inches long and for ease in handling and installing on a roof are made thick enough to be self supporting when stiffened by a lengthwise raised feature 14 stiffening the strip 10.

In order to intensify the extent that such metallic ions are released into rainwater runoff, offset lengthwise aligned rows of elongated depressions 12 are formed into the metal, as described in U.S. Pat. No. 9,103,124. The depressions capture rainwater therein increasing the residence time that rainwater is held in contact with the copper or other metal strip surfaces, and thus creating more ions released into the rainwater runoff.

The depressions 12 have slits 13 at the bottom allowing some of the captured rainwater to percolate through the strips 10 which then seeps beneath the strips 10 to thereby be brought into contact with the underside thereof to further intensify the release of ions into the rainwater runoff. This is described in U.S. Pat. No. 9,103,124.

The raised lengthwise feature 14 also temporarily impounds the water to also contribute to the release of ions by increasing the residence time of the rainwater in contact with the metal as well as stiffens the strip 10 for ease in handling when installing the same.

According to the present invention, the strip 10 is widened somewhat over the prior version such as to a width on the around 4½ inches, adding a half of an inch or more to the top side of the strip 10. This creates a nailing and tab flange 16 which has sets of three predrilled holes 18 distributed along the length thereof for a purpose to be described hereinafter.

Figures 5, 6:
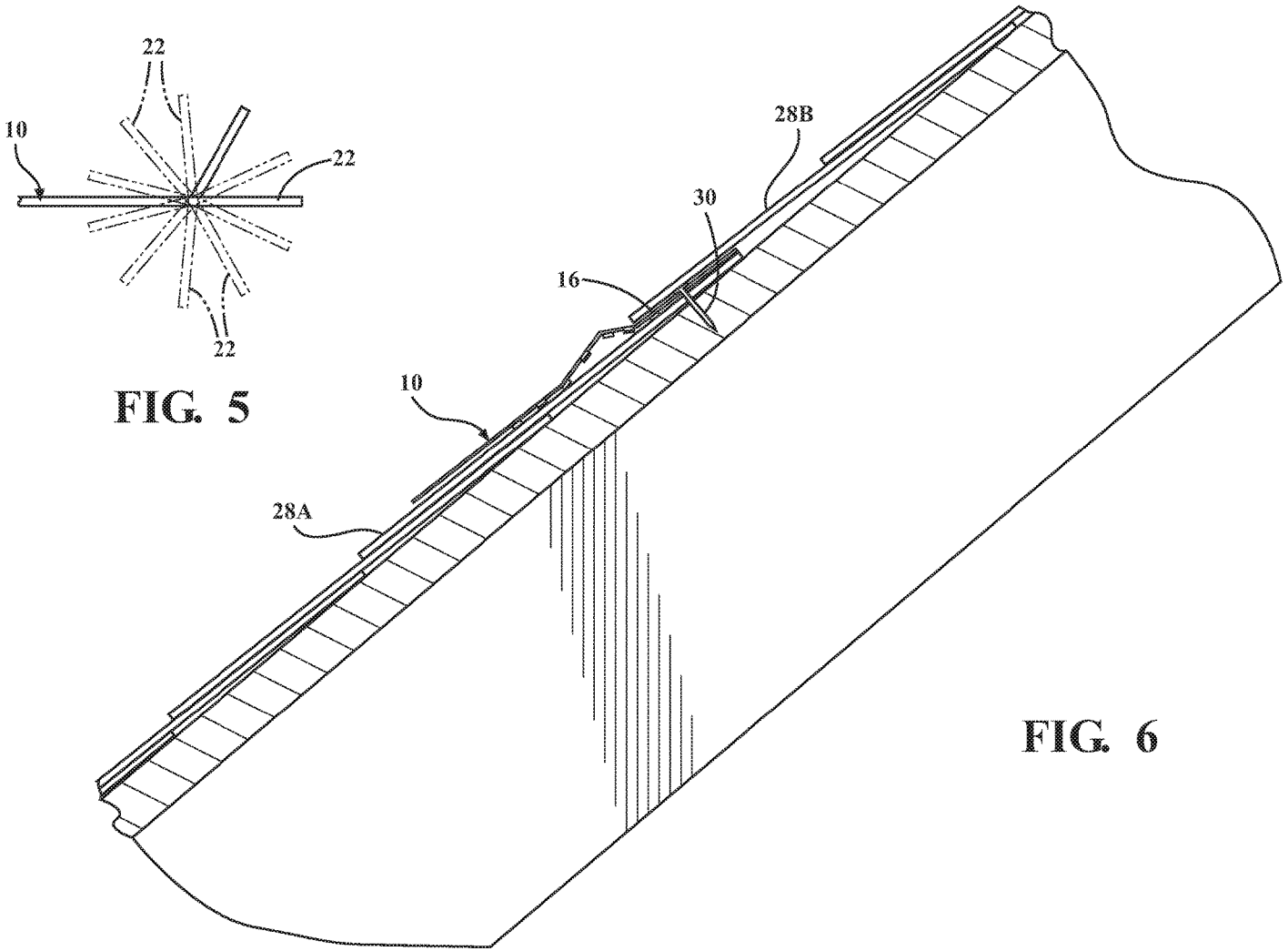
FIG. 5 is an end view of the strip shown in FIG. 4 showing varying bent over positions of a retention tab included in the roofing strip according to the invention.
FIG. 6 is a sectional view of a metal strip installed on a shingled roof shown in fragmentary form.

The uppermost section 20 of the strip 10 has a series of rectangular tabs 22 each formed by spaced apart pairs of slots 24 connected by a crease 26 to make easier straighter bending of the tabs 22 up or down from the general plane of the strip 10 and either back up or down from the remaining portions of the strips 10 as seen in FIG. 5.

The tabs 22 are used when the strips 10 are installed on tile roofs to be engaged and secured thereto.

The strips 10 are designed to be used with any type of pitched roof, i.e. with either asphalt shingled roofs or with any of the various types of tile roofs.

FIG. 6 shows a strip 10 installed on asphalt shingled roof in which asphalt shingles 28 are lapped over each other in an upward projection in the well known manner.

Figure 7:
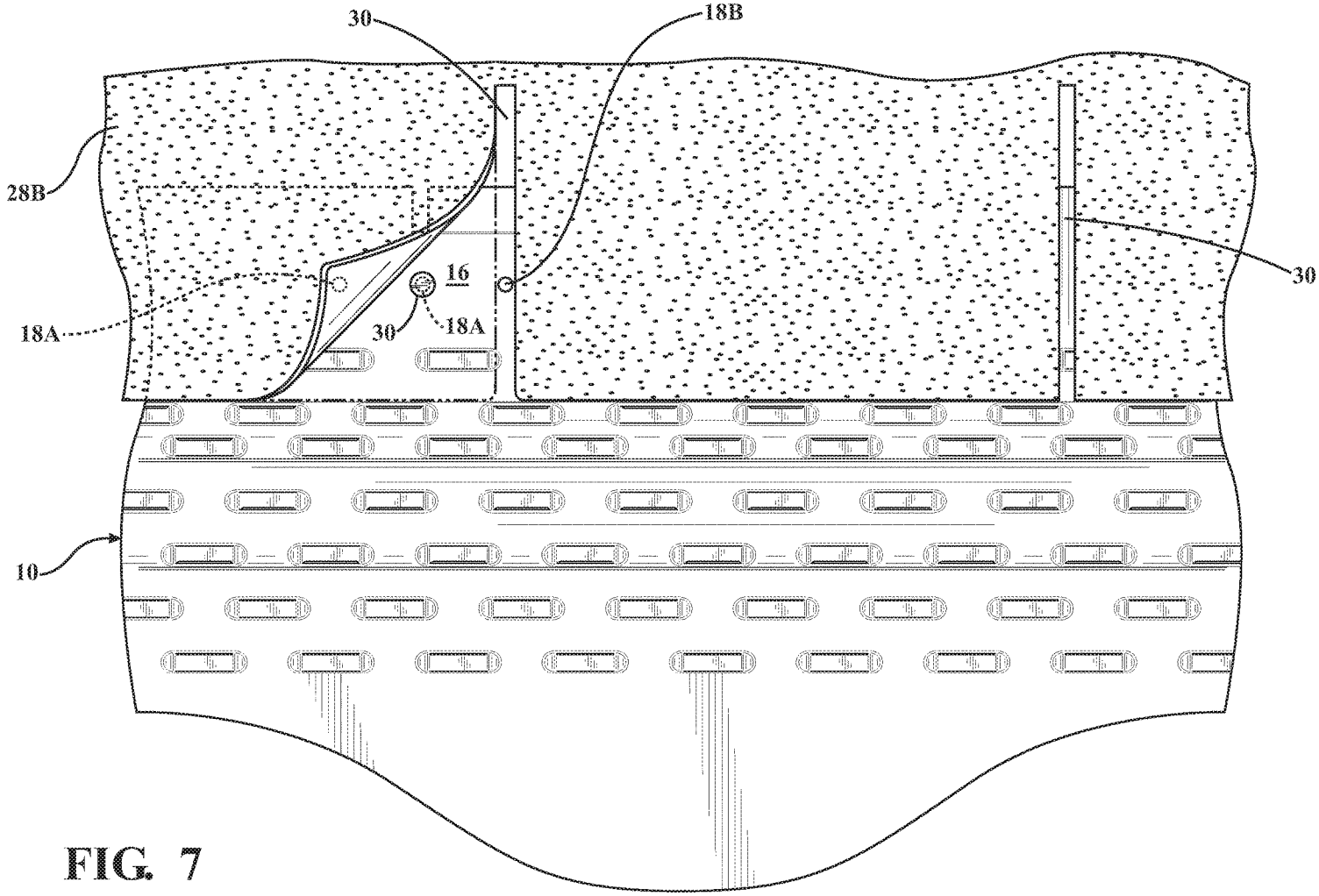
FIG. 7 is a pictorial view of a shingled roof section with a corner of a section of a shingle pulled open to show an installed nail.

Referring to FIG. 7, the upper nailing flange 16 is nailed through the upper part of a shingle 28A which in turn is lapped over the next shingle 28B.

The nails 30 should be located so as to be covered by the lower part of the shingle 28B. However, asphalt shingles are usually slotted which randomly recurring slots 30.

The strips 10 are formed with the sets of predrilled or punched holes 18 in order to be easier to install as the nails do not have to be forced through the thickness of the strips 10. However, it may sometimes happen that single nail holes 18A may turn out to be aligned with the slotted opening 30 which the strips 10 are installed end to end beneath existing shingles 28A, 28B.

The provision of a plurality of holes 18A-18C, i.e., three holes 18A, 18B, 18C allows an installer to use another of the three holes 18B or C to locate the nail head so as to be covered by the shingle 28B as shown in FIG. 7.

Figure 8:
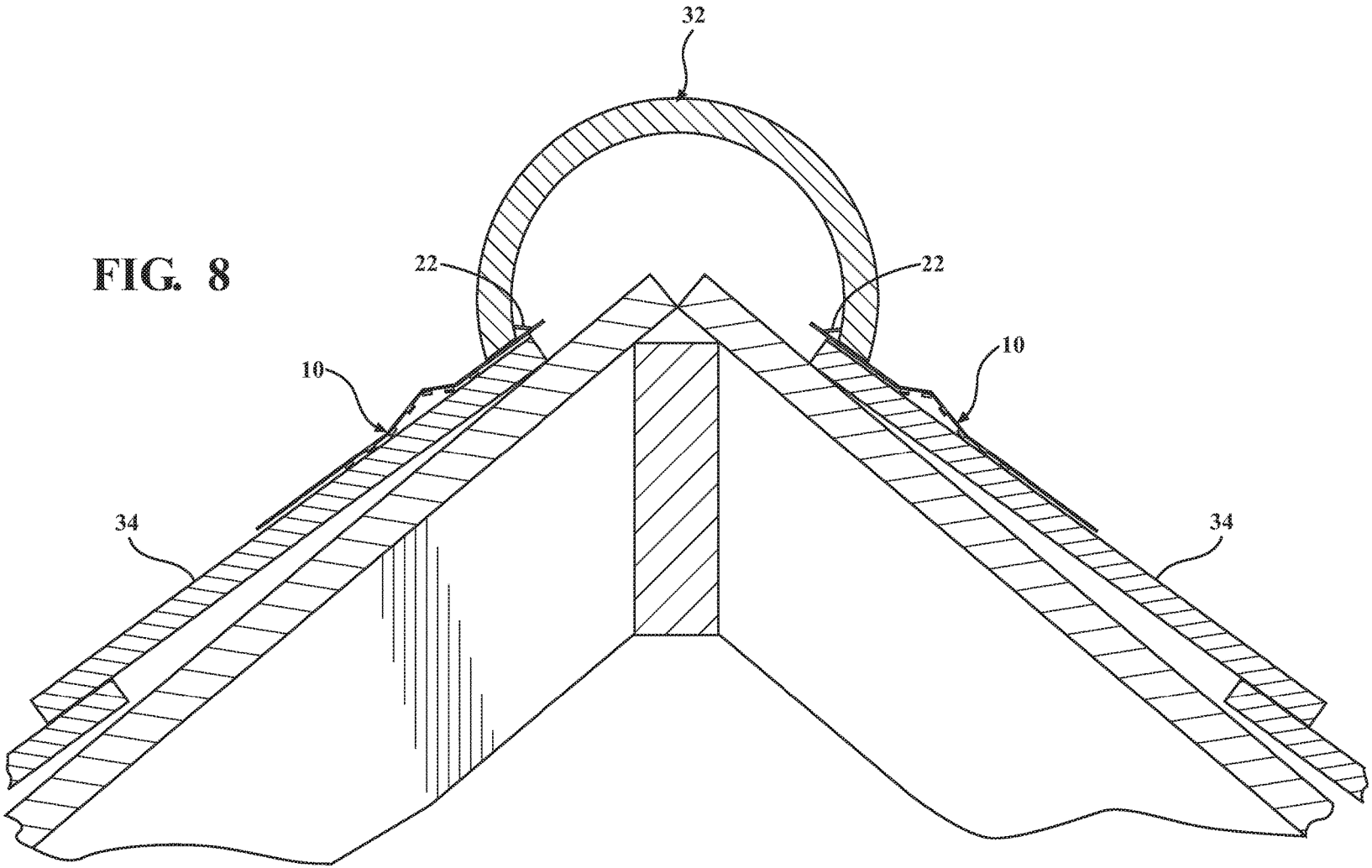
FIG. 8 is a sectional view of the crest of a tiled roof with a strip according to the invention installed thereon.

FIG. 8 shows the use on the tabs 22 with a tile roof in which a course of ridge tiles 32 shaped as a partial circle overlay flat field tiles 34. In this case, the tabs 22 may be reversely bent back over the remaining portions of the strip 10. This engages in inner surface of the ridge tiles 32 to securely resist being pulled out. Suitable caulk can also be used beneath the strips 10 to further improve retention.

In a tile roof, the strips 10 are limited to a single course just below the ridge as shown.

Figures 9, 9A:
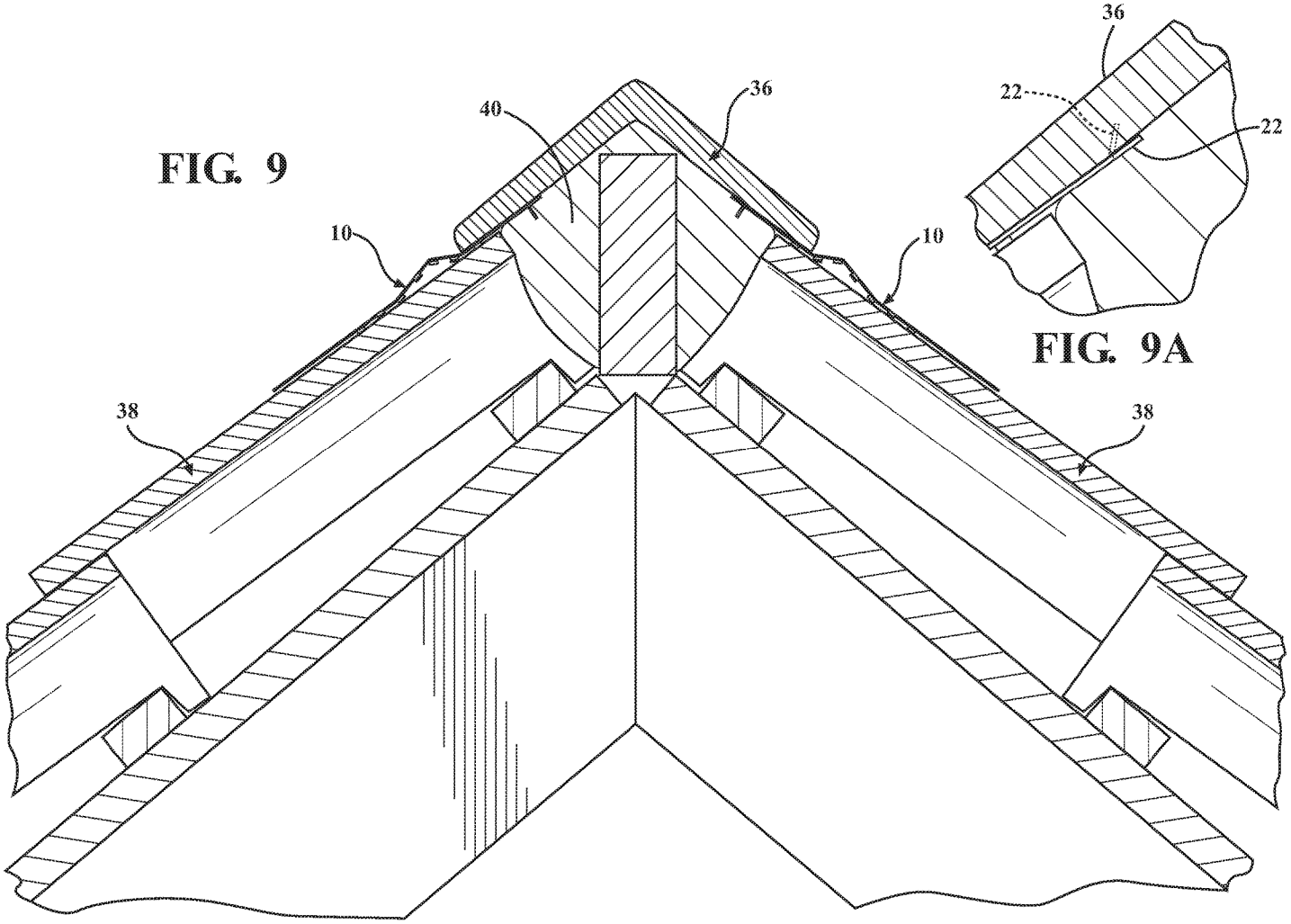
FIG. 9 is a sectional view of the crest of another type of tile roof with a strip according to the invention installed thereon.
FIG. 9A is an enlarged sectional view of alternative engagement of a tab tile undersurface.

FIG. 9 shows installation of the strips with a tile roof in which a flat angled ridge tiles 36 overlie partially circularly shaped field tiles 38. Such field tiles 38 leave gaps which are often filled with mass of a suitable mortar 40.

In this case, the tabs 22 can be bent down into the mortar if wet as shown, to create a very secure retention of the strips 10.

In the case where the mortar has set, the tabs 22 can be bent up at an angle (FIG. 9A) before the installation of the ridge tiles 36 as shown in broken lines in FIG. 9A.

The field tiles 36 are then installed over the strips 10, tending to bend down the tabs 22 to a flattened state. This accommodates varying sized gaps with the undersurface of the ridge tiles 36 and insuring a tight frictional engagement between the tabs 22 and the undersurface of the ridge tiles 36.

Many other generally similar roof tile installations can have strips according to the invention bent at various angles to be sure of engaging with the tiles.

Accordingly, the strips 10 according to the invention can be installed for most shingled and tile roof installations.

The invention claimed is:

1. A roofing antigrowth strip adapted to be installed on either a shingled or tiled roof, said strip constructed of an elongated solid strip of metal which releases ions into rainwater runoff of a type which inhibit growths of moss, mildew, and lichens, said strip metal having areas formed with indentations therein capturing rainwater with openings in said indentations allowing rainwater runoff to pass through said strip and contact an undersurface of a flat lower section thereof lying flat on a roof to increase the release of ions into said runoff, said strip including an upper nailing flange section adapted to be installed under roof covering pieces with remaining parts of said strip extending over roofing pieces and exposed to rainwater, said strip having a series of tabs formed in said upper nailing flange section of said strip by spaced apart pairs of slots cut into an upper edge of said upper nailing flange section along the length of the strip, which tabs are able to be bent up and back out so as to be engageable with roofing tiles installed over said tabs so that said upper nailing flange section is held in position by engagement on said roof;

said upper nailing flange section also formed with a plurality of lengthwise spaced apart sets of preformed nailing holes each adjacent to the other in each set formed spaced apart, said sets arranged spaced apart along the length of said upper nailing flange section and below said tabs, said sets of nailing holes located to ensure that a head of a nail inserted in at least one hole of each set and driven into underlying roof deck will be covered by the roofing tiles and not exposed by any slots in said roofing tiles installed on the roof, with a lower edge of the roofing tiles overlying said upper nailing flange section of said strip.

2. A method of securing antigrowth solid sheet metal roofing strips to a tile roof installed on said roof, over an upper section of said metal strips leaving a lower main section of said strips exposed, including forming bendable tabs along said upper section of said strips by cutting a series of spaced apart pairs of slots into an edge extending along and above said upper section of said strips and bending said tabs up to be above a plane generally defined by each strip so as to be ensured of engaging an undersurface of a tile piece installed over said strip upper section so as to retain said strip to said tile roof by said tile piece frictionally engaged therewith; and, forming sets of adjacent holes into said upper section of said strip, said sets spaced apart lengthwise along the length of said strip and located below said tabs so as to insure that one holes in each set will be covered by the tile piece so as to avoid exposing a head of a fastener installed in a hole of any of said set of holes in said strip.

* * * * *